US010367268B2

(12) United States Patent
Oshima et al.

(10) Patent No.: US 10,367,268 B2
(45) Date of Patent: Jul. 30, 2019

(54) LEAKY-WAVE ANTENNA

(71) Applicant: DENKI KOGYO COMPANY, LIMITED, Tokyo (JP)

(72) Inventors: Ichiro Oshima, Tokyo (JP); Takuya Seki, Tokyo (JP)

(73) Assignee: Denki Kogyo Company, Limited (JP)

( * ) Notice: Subject to any disclaimer, the term of this patent is extended or adjusted under 35 U.S.C. 154(b) by 0 days.

(21) Appl. No.: 15/551,794

(22) PCT Filed: Feb. 19, 2015

(86) PCT No.: PCT/JP2015/054550
§ 371 (c)(1),
(2) Date: Aug. 17, 2017

(87) PCT Pub. No.: WO2016/132499
PCT Pub. Date: Aug. 25, 2016

(65) Prior Publication Data

US 2018/0040961 A1 Feb. 8, 2018

(51) Int. Cl.
*H01Q 13/20* (2006.01)
*H01Q 21/26* (2006.01)
(Continued)

(52) U.S. Cl.
CPC ..... *H01Q 13/20* (2013.01); *H01Q 1/38* (2013.01); *H01Q 15/0086* (2013.01);
(Continued)

(58) Field of Classification Search
CPC ..... H01Q 13/20; H01Q 21/245; H01Q 21/24; H01Q 25/001; H01Q 21/26; H01Q 1/38; H01Q 15/0086
(Continued)

(56) References Cited

U.S. PATENT DOCUMENTS 3,155,975 A 11/1964 Chatelain
7,508,283 B2 * 3/2009 Itoh ..... H01P 5/227 333/109
(Continued)

FOREIGN PATENT DOCUMENTS

JP 200960568 A 3/2009
JP 2009296559 A 12/2009
(Continued)

OTHER PUBLICATIONS

Extended European Search Report for Application No. 15882602.4 dated Aug. 6, 2018, 10 pages.
(Continued)

*Primary Examiner* — Hai V Tran
(74) *Attorney, Agent, or Firm* — Lerner, David, Littenberg, Krumholz & Mentlik, LLP

(57) ABSTRACT

To provide a leaky-wave antenna that allows dual-polarization without limiting an emission range to either side. The antenna includes as an element unit (AE) a CRLH transmission line configured by multiply connecting CRLH unit cells (UC) in a periodic fashion between one ends and the other ends of two parallel lines (La, Lb). The respective unit cells (UC) have a left-handed series capacitor (C1, C2) on each of the two parallel lines (La, Lb) and have a left-handed parallel inductor (L1) between the two parallel lines (La, Lb). When power is fed between the two parallel lines (La, Lb), the two parallel lines (La, Lb) and the series capacitor (C1, C2) serve to emit a vertical polarization component, and the parallel inductor (L1) and a conductor between the two parallel lines (La, Lb) serve to emit a horizontal polarization component.

14 Claims, 9 Drawing Sheets

(51) Int. Cl.

| | |
|---|---|
| ***H01Q 21/24*** | (2006.01) |
| ***H01Q 1/38*** | (2006.01) |
| ***H01Q 15/00*** | (2006.01) |
| ***H01Q 25/00*** | (2006.01) |

(52) U.S. Cl.
CPC ..... *H01Q 21/24* (2013.01); *H01Q 21/245* (2013.01); *H01Q 21/26* (2013.01); *H01Q 25/001* (2013.01)

(58) Field of Classification Search
USPC ..... 343/777
See application file for complete search history.

(56) References Cited

U.S. PATENT DOCUMENTS

| | | | | |
|---|---|---|---|---|
| 2009/0245146 | A1* | 10/2009 | Gummalla ..... | H01Q 1/2283 370/281 |
| 2010/0019863 | A1* | 1/2010 | Iguchi ..... | H01P 1/215 333/185 |
| 2011/0148727 | A1* | 6/2011 | Chang ..... | H01Q 13/20 343/777 |
| 2013/0120217 | A1 | 5/2013 | Ueda et al. | |
| 2013/0321093 | A1 | 12/2013 | Ueda et al. | |

FOREIGN PATENT DOCUMENTS

| | | | |
|---|---|---|---|
| JP | 2010028534 | A | 2/2010 |
| WO | 2012014984 | A1 | 2/2012 |
| WO | 2012115245 | A1 | 8/2012 |
| WO | 2014174153 | A1 | 10/2014 |

OTHER PUBLICATIONS

Mohammed Reza M Hashemi et al, " Coupled Composite Right/Left-Handed Leaky-Wave Transmission Lines Based on Common/Differential-Mode Analysis", IEEE Transactions on Microwave Theory and Techniques, Plenum, USA, vol. 58, No. 12, Dec. 1, 2010 (Dec. 1, 2010), pp. 3645-3656, XP011338311.

Ikeda et al., "Beam-scanning Performance of Leaky-wave Slot Array Antenna on Variable Stub-loaded Left-handed Waveguide", IEEE Transactions on Antennas and Propagation, vol. 56, issue 12, pp. 3611-3618, Dec. 2008.

Liu et al., "Dominant mode leaky-wave antenna with backfire-to-endfire scanning capability", Electronic Letters, vol. 38, No. 23, pp. 1414-1416, Nov. 7, 2002.

International Search Report for PCT/JP2015/054550 dated Apr. 7, 2015.

Korean Office Action for Application No. 10-2017-7026223 dated Nov. 2, 2018.

* cited by examiner

LEAKY-WAVE ANTENNA

CROSS-REFERENCE TO RELATED APPLICATIONS

The present application is a national phase entry under 35 U.S.C. § 371 of International Application No. PCT/JP2015/054550 filed Feb. 19, 2015, which is incorporated herein by reference.

FIELD OF THE INVENTION

The present invention relates to a leaky-wave antenna suitable for a base station antenna for mobile communications.

BACKGROUND ART

In the field of mobile communications, large-capacity and high-speed communication techniques have been developed. Among these, MIMO (Multi-Input Multi-Output) techniques in which multiple transmitting antennas and multiple receiving antennas are used have been put into practical use. The MIMO antennas need to have reduced correlation so as to ensure independent communication channels.

Many cell phone base stations adopt a dual-polarized antenna using two orthogonal polarizations such as vertical and horizontal polarizations or +45 degree and −45 degree polarizations. The dual-polarized antenna has advantages such as implementation of antenna branches for two systems, i.e., two-branch MIMO communications, low correlation between the two antennas, and size reduction attributed to the fact that antennas can be installed close together.

To give examples of currently available base station antennas, there are a sector antenna capable of covering a sector-shaped area, an omnidirectional antenna capable of covering a circular area, a planar antenna or Yagi antenna capable of covering an area at a certain spot, etc. Many of these antennas can use both the vertical polarization and the horizontal polarization.

Most of the base station antennas using both the vertical and horizontal polarizations are array antennas composed of dipole elements. The antenna of this type emits a vertical polarization from a dipole element installed vertically to the ground and emits a horizontal polarization from the one installed horizontally to the ground. The above sector antenna, omnidirectional antenna, and planar antenna, etc. can be designed in various ways by changing the dipole element array. Note that the Yagi antenna is not an array antenna and instead, has multiple parasitic elements arrayed in front of dipole elements.

These dual-polarized antennas are expected to be as compact as possible so as to reduce wind load and improve appearance, for example. For that purpose, numerous trials are ongoing to reduce size and to make such a dual-polarized antennas thinners, but these efforts seem to have nearly reached their limits.

On the other hand, periodic antenna structures, incorporating metamaterial, have been studied and tentatively applied to mobile communication antennas. The metamaterial antennas show characteristics unexpected from common antennas and also allow size reduction. Their applications to mobile communication antennas are therefore promising, but only a few applications have been reported.

A leaky-wave antenna using a CRLH (Composite Right/Left-Handed) transmission line is known as such a metamaterial antenna. The leaky-wave antenna emits leaky waves forward in right-handed bands and emits leaky waves backward in left-handed bands. Advantageously, this provides wide-angle beam scanning Non-Patent Literature 1 proposes a CRLH leaky-wave antenna with microstrip transmission lines. Non-Patent Literature 2 proposes a CRLH leaky-wave antenna with a waveguide.

CITATION LIST

Non-Patent Literature

Non-Patent Literature 1: L. Liu, et al., "Dominant mode leaky-wave antenna with backfire-to-endfire scanning capability, Electronics Letters, vol. 38, no. 23, pp. 1414-1416, November 2002.

Non-Patent Literature 2: T. Ikeda, et al., Beam-scanning performance of leaky-wave slot-array antenna on variable stub-loaded left-handed waveguide, Proceedings of ISAP2007, 4E3-2, pp. 1462-1465, 2007.

SUMMARY OF INVENTION

Technical Problem

The leaky-wave antenna disclosed in Non-Patent Literature 1 emits polarization components parallel to a transmission line, whereas that disclosed in Non-Patent Literature 2 emits polarization components vertical to a transmission line. Most conventional leaky-wave antennas can only emit a polarization in either the vertical or horizontal direction, and thus, are generally incapable of dual polarization. Furthermore, the antenna of Non-Patent Literature 1 can emit only in the upper half of an emission range because its ground plate is disposed below the transmission line. Also, the antenna of Non-Patent Literature 2 allows emission from slots only in the upper half of an emission range. Almost incapable of dual-polarization as above, the conventional CRLH leaky-wave antennas are hardly applicable to MIMO-based mobile communication antennas. Also, due to the drawback that their emission range is limited to either side, they cannot be readily applied to the omnidirectional antennas, either.

In view of the above circumstances, the present invention has an object to provide a leaky-wave antenna that allows dual-polarization without limiting its emission range to either side.

Solution to Problem

A leaky-wave antenna according to the present invention comprises as an element unit a CRLH transmission line configured by multiply connecting CRLH unit cells in a periodic fashion between one ends and the other ends of two parallel lines. The unit cells each have a left-handed series capacitor on each of the two parallel lines and have a left-handed parallel inductor between the two parallel lines.

When power is fed to the two parallel lines, the two parallel lines and the series capacitor serve to emit a vertical polarization component and also, the parallel inductor and a conductor between the two parallel lines serve to emit a horizontal polarization component.

According to an aspect of the invention, the element unit is configured so that the vertical polarization component and the horizontal polarization component can be emitted in the same amount.

According to another aspect of the invention, the element unit is configured so that its directivity in a vertical plane is of an end-fire pattern.

According to still another aspect of the invention, a leaky-wave antenna, comprising the aforementioned leaky-wave antenna as first and second antennas, can be provided. In the antenna, the first and second antennas have element units that are combined orthogonal to each other with their longitudinal axial lines being aligned.

The element units of the first and second antennas are preferably displaced from each other along the longitudinal axial line by half a length of the respective unit cells arrayed periodically.

The element units of the first and second antennas are configured, as needed, so that their directivity in a vertical plane is of an end-fire pattern.

According to still yet another aspect of the invention, the antenna may further comprise a reflector for narrowing a beam width in a horizontal plane.

An interdigital capacitor or a parallel plate capacitor, for example, is used as the series capacitor. Also, a straight thin line or a meandering line, for example, is used as the parallel inductor. Moreover, a chipped element may be used as the series capacitor and the parallel inductor.

Advantageous Effects of Invention

The leaky-wave antenna according to the present invention can emit polarization components parallel as well as vertical to the transmission line, and hence dual-polarization can be easily performed. This realizes the application to the MIMO-based mobile communication antenna. The emission range is not limited to either side, and it can be readily applied to the omnidirectional antenna as well. Moreover, because of being compact and thin, the antenna is also suitable for a base station antenna for mobile communications.

DESCRIPTION OF EMBODIMENTS

Preferred embodiments of the present invention will be described in detail below with reference to the accompanying drawings.

Figure 1:
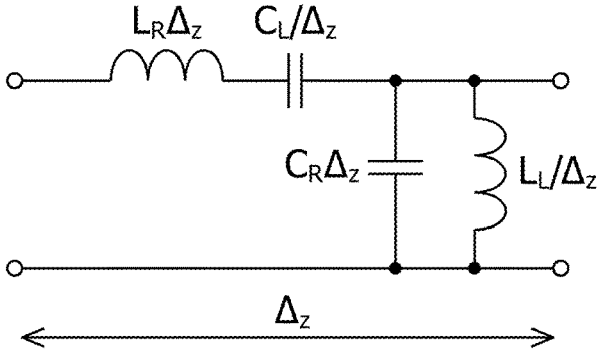
FIG. 1 is an equivalent circuit diagram of unit cells on a CRLH transmission line.

FIG. 1 shows an equivalent circuit of CRLH (Composite Right/Left-Handed) unit cells each having the length Az. When multiply connected in a periodic fashion, these unit cells can establish a CRLH transmission line. A typical transmission line, i.e., right-handed transmission line consists of an inductance element $L_R$ and a capacitance element $C_R$ alone. In contrast, the CRLH transmission line includes left-handed series capacitance element $C_L$ and parallel inductance element $L_L$ in addition to the above elements. Thus, this CRLH transmission line can provide, using the four parameters $L_R$, $C_R$, $L_L$, and $C_L$, a right-handed frequency band with phase propagating forward and a left-handed frequency band with phase propagating backward.

Figure 2:
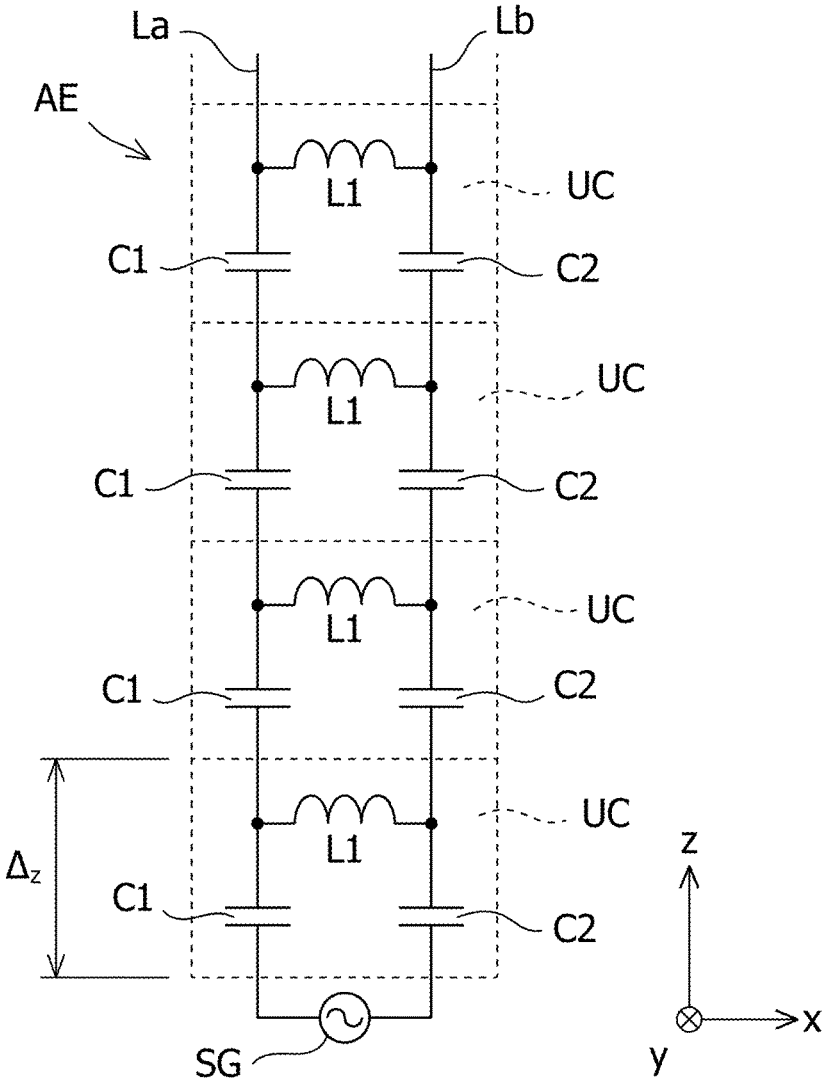
FIG. 2 is a schematic diagram showing an embodiment of a leaky-wave antenna according to the present invention.

FIG. 2 shows an embodiment of a leaky-wave antenna using a CRLH transmission line according to the present invention. The leaky-wave antenna incorporates an element unit AE implemented by the CRLH transmission line. The element unit AE has CRLH unit cells UC of the length Δz, which are installed between one ends and the other ends of two parallel transmission lines La, Lb and multiply connected in a periodic fashion. Each unit cell UC includes as left-handed elements a series capacitor C1 on the line La, a series capacitor C2 on the line Lb, and a parallel inductor L1 inserted between the lines La, Lb. Here, the respective unit cells UC basically have the same capacitance values at the capacitors C1, C2 and the same inductance value at the inductor L1, yet these capacitance and inductance values can be finely adjusted for the capacitors C1, C2 and the inductor L1 in one or more unit cells UC so as to further optimize antenna characteristics.

In FIG. 2, the circuit portion (as indicated by the lines) excluding the capacitors C1, C2 and inductor L1 arranged does not merely refer to a connection form but also to a physical conductive member. What is illustrated in FIG. 2 is a substantial circuit including the conductive member, not an equivalent circuit.

The element unit AE, implemented by the CRLH transmission line, also includes right-handed inductance and capacitance elements made up of the physical conductive member, etc. FIG. 2 is not an equivalent circuit diagram, in which the right-handed inductance and capacitance elements are therefore not represented by circuit symbols.

Figure 3:
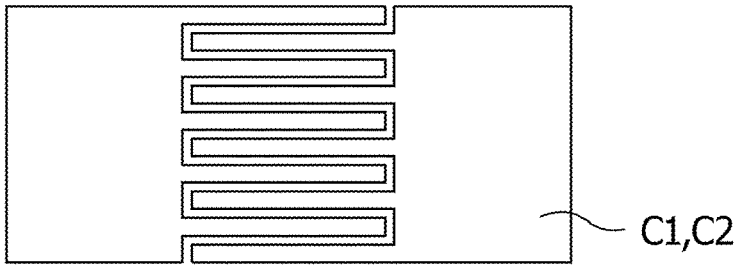
FIG. 3 is a plan view of an example of a capacitor.
Figure 4A:
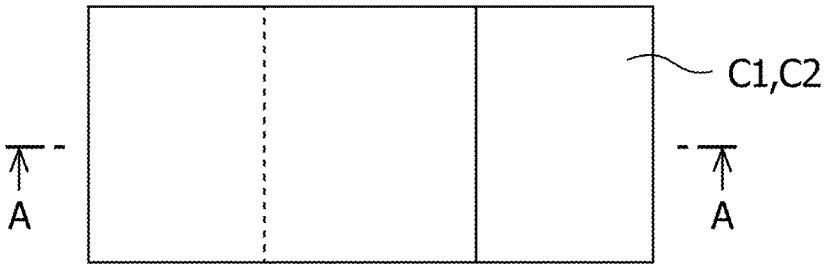
FIG. 4A is a plan view of another example of the capacitor.
Figure 4B:
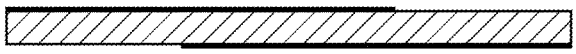
FIG. 4B is a sectional view taken along line A-A of FIG. 4A.
Figure 5:
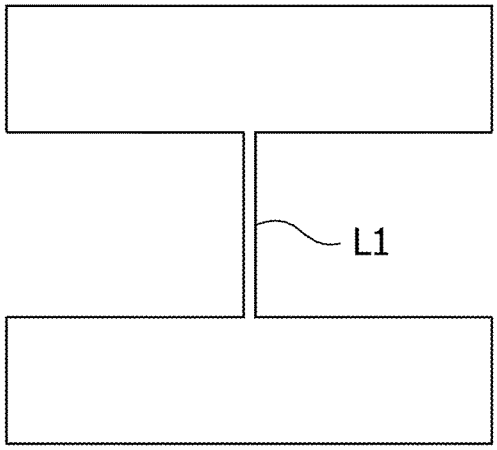
FIG. 5 is a plan view of an example of an inductor.
Figure 6:
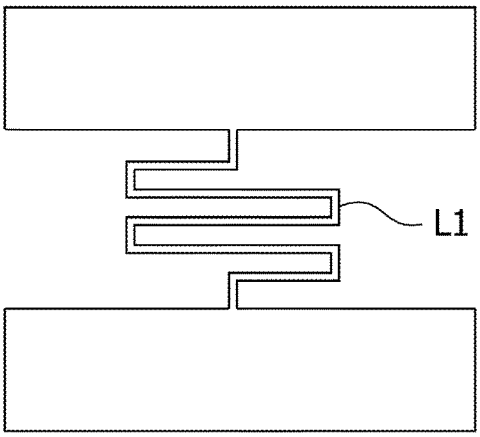
FIG. 6 is a plan view of another example of the inductor.

In case of implementing the element unit AE by strip transmission lines, an interdigital capacitor of FIG. 3 or a parallel plate capacitor of FIGS. 4A and 4B, for example, can be used as the capacitors C1, C2, whereas a straight thin line of FIG. 5 or a meandering line of FIG. 6, for example, can be used as the inductor L1. These capacitors C1, C2 and inductor L1 can be prepared by a printed board manufacturing technique, etc. Needless to say, a chipped element is also applicable to the capacitors C1, C2 and the inductor L1.

In FIG. 2, an array direction z of the unit cells UC is called a vertical direction. FIG. 4A is a plan view and FIG. 4B is a sectional view taken along line A-A of FIG. 4A.

The leaky-wave antenna of this embodiment can operate while being open at the terminal (upper) end of the element unit AE as illustrated. In this regard, however, fewer unit cells UC arranged would result in large reflection from the terminal end. If so, it is preferred that a terminating resistor be connected there, which has equivalent impedance to characteristic impedances of the two parallel lines La, Lb, in order to suppress the reflection from the terminal end.

Next, operations of the leaky-wave antenna of this embodiment are described. The leaky-wave antenna of Non-Patent Literature 1 predominantly emits polarization components parallel to the transmission line.

In contrast, the leaky-wave antenna of this embodiment can emit both vertical polarization and horizontal polarization from the element unit AE. That is, in the leaky-wave antenna of the present invention, a signal generator SG connected between ends of the two parallel lines La, Lb feeds power in a differential mode. As a result, vertical polarization components are emitted from the lines La, Lb and the capacitors C1, C2, while horizontal polarization components are emitted from a thin line connecting the lines La, Lb and the inductor L1. The vertical polarization components emitted in the y direction are cancelled, whereby the maximum emission is achieved in the x direction. The reason the y-direction emission is cancelled is that opposite-phase currents flow in the two parallel lines La, Lb. In addition, horizontal polarization components are not emitted in the x direction, whereby the maximum emission is achieved in the y direction.

The leaky-wave antenna of this embodiment, operating as above, can emit vertical and horizontal polarizations, and thus, can be readily applied to the MIMO-based mobile communication antennas.

Figure 7:
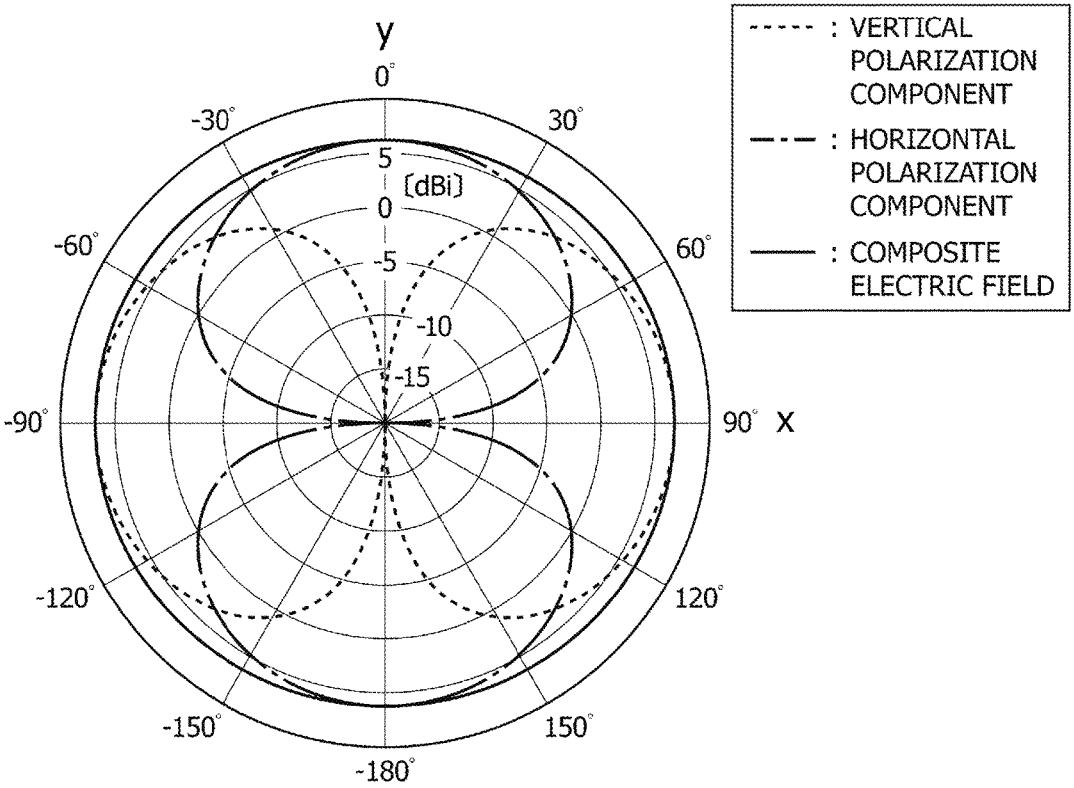
FIG. 7 is a graph showing an example of a directivity in a horizontal plane.

Amounts of vertical and horizontal polarization components, emitted from the leaky-wave antenna of this embodiment, can be adjusted according to the line width or pitch of the two parallel lines La, Lb, the structure of the capacitors C1, C2 or the inductor L1, the length Δz of the unit cell UC, etc. In an illustrated example of FIG. 7, adjustment is done so that vertical polarization components (indicated by the dotted line) and horizontal polarization components (indicated by the dashed line) can be emitted in the same amount. In this case, their composite electric field in a horizontal plane (indicated by the solid line) exhibits no directivity. This means the leaky-wave antenna of this embodiment is readily applicable to omnidirectional antennas as well.

The amounts of vertical and horizontal polarization components emitted can be also adjusted according to the number of capacitors or inductors per unit cell. More specifically, the greater the number of inductors, the more the horizontal polarization components increase. Also, the greater the number of capacitors, the more the vertical polarization components increase.

Figure 8:
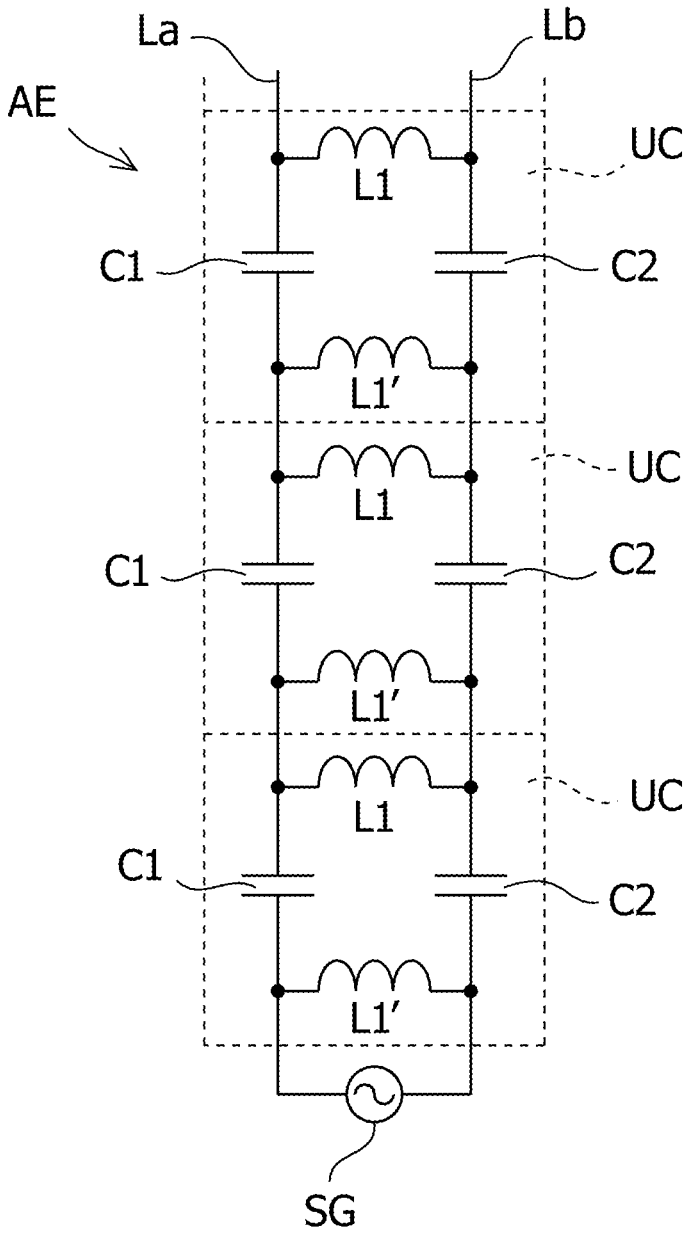
FIG. 8 is a schematic diagram of a configuration example with a larger number of inductors.
Figure 9:
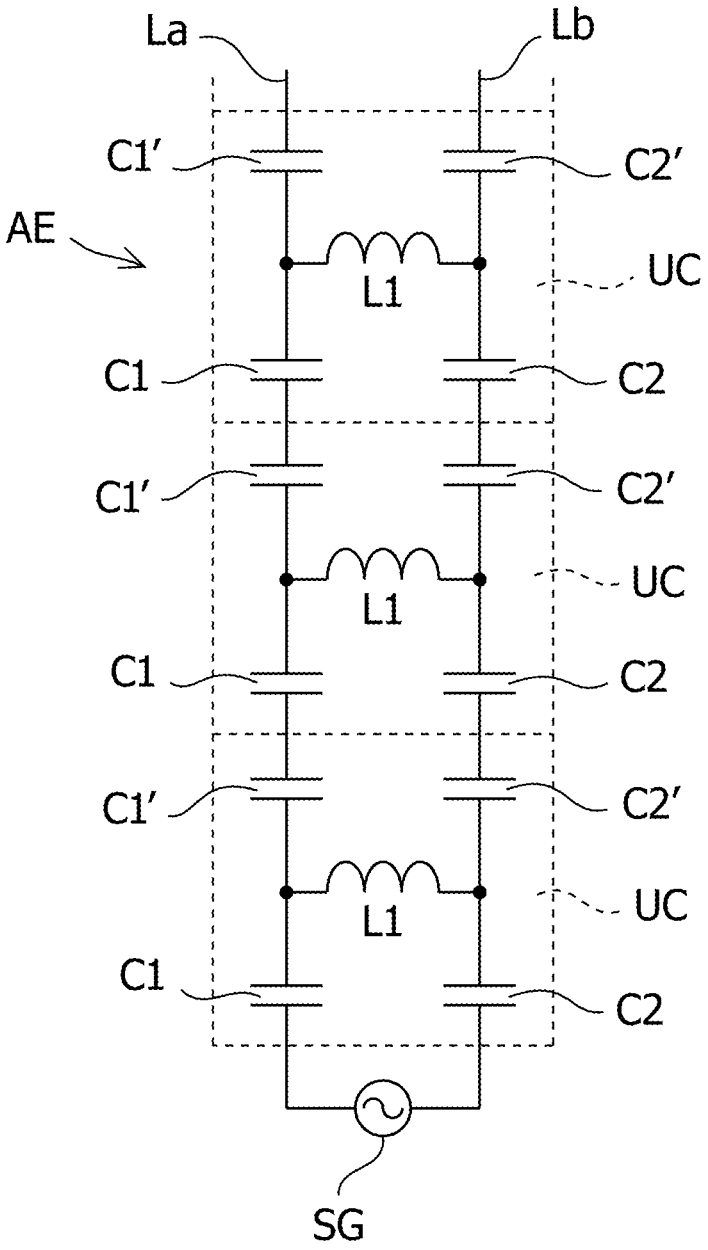
FIG. 9 is a schematic diagram of a configuration example with a larger number of capacitors.

FIG. 8 shows an example of adding a parallel inductor L1' in the unit cell UC so as to increase the horizontal polarization components. The inductor L1' is disposed symmetric to the inductor L1 across the capacitors C1, C2. FIG. 9 shows an example of adding series capacitors C1', C2' in the unit cell UC so as to increase the vertical polarization components. The capacitors C1', C2' are connected in series to the capacitors C1, C2, respectively. Here, the number of parallel inductors or series capacitors added in each unit cell UC is not limited to one, and further, each unit cell UC can add both of a parallel inductor and a series inductor.

The leaky-wave antenna of the present invention can be made thinner by reducing the size of each unit cell UC of the element unit AE and placing the lines La, Lb more closely. In this regard, the closer lines La, Lb would lead to reduction particularly in emission of horizontal polarization components. It can be dealt with taking some effective measures such as "adding a parallel inductor to a unit cell UC" and "reducing the length (indicated by Δz in FIG. 2) of the respective unit cells UC arrayed periodically, thereby reducing the array pitch between the parallel inductors".

The leaky-wave antenna of this embodiment assures an antenna diameter of, for example, 0.1 wavelength at most.

Figure 10:
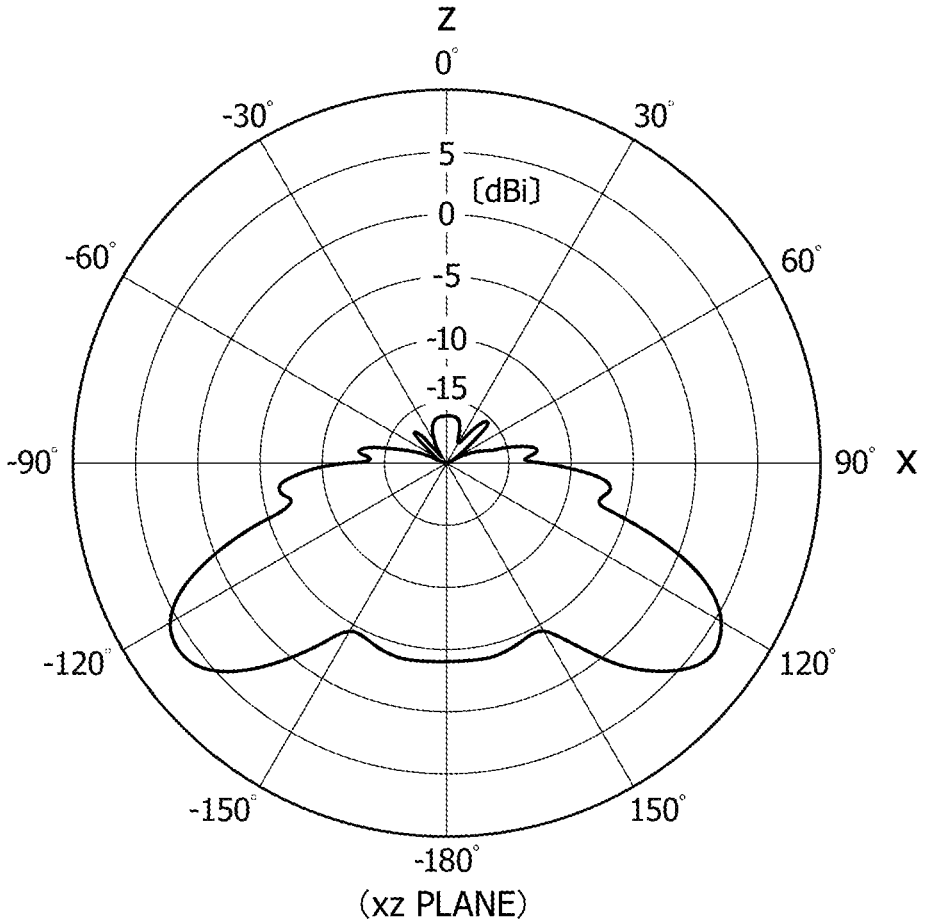
FIG. 10 is a graph showing a directivity in a vertical plane (xz plane) when multiple (thirty) unit cells are arranged.
Figure 11:
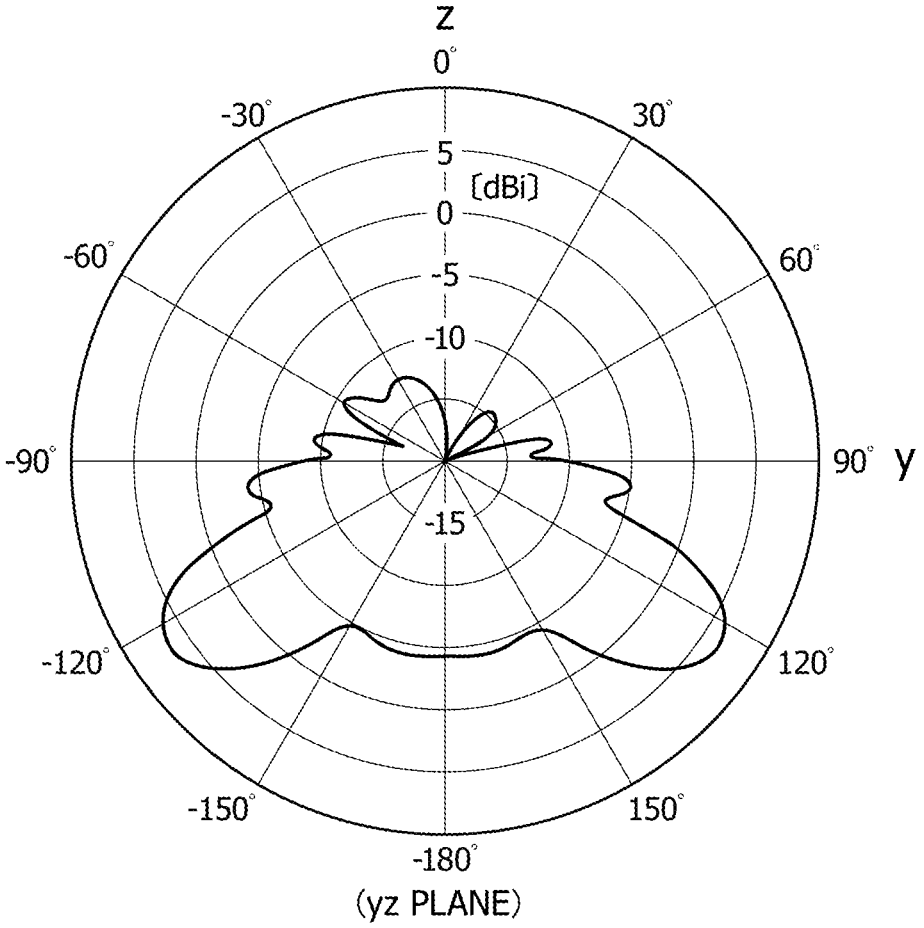
FIG. 11 is a graph showing a directivity in a vertical plane (yz plane) when multiple (thirty) unit cells are arranged.

FIGS. 10 and 11 exemplify directivities in xz and yz planes (both are vertical planes) of the element unit AE, respectively, when thirty unit cells UC are arranged.

Here, the horizontal polarization is dominant in the xz plane, whereas the vertical polarization is dominant in the yz plane.

The directivities in a vertical plane, shown in FIGS. 10 and 11, are observed in the left-handed band and hence tilted downward. As understood from the figures, such a high gain as substantially 30-degree beam tilt is obtained and no grating lobe occurs, although such grating lobe would appear in common array antennas.

Figure 12:
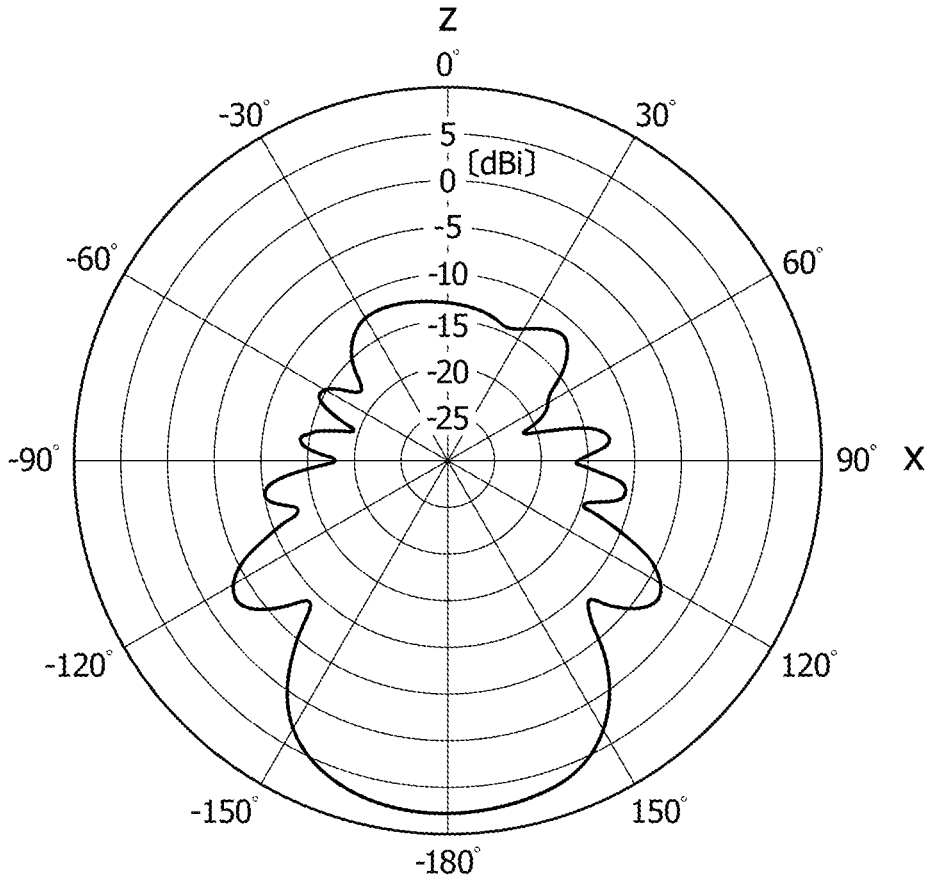
FIG. 12 is a graph showing an example of a directivity, in a vertical plane, of an end-fire pattern.

FIG. 12 shows a directivity in a vertical plane of the element unit AE in case a phase difference is further increased among the unit cells UC to thereby achieve large beam tilt. The illustrated directivity in a vertical plane shows that the beam is completely directed downward (-z direction). Such its directivity in a vertical plane is of an end-fire pattern as with a Yagi antenna. Hence, if given such a directivity, the antenna of the present invention can replace a Yagi antenna. The width of a Yagi antenna is almost half a wavelength. In contrast, the antenna of the present invention assures the antenna diameter of, for example, about 0.1 wavelength as above, and thus, can be made much thinner than a Yagi antenna can.

Figure 13:
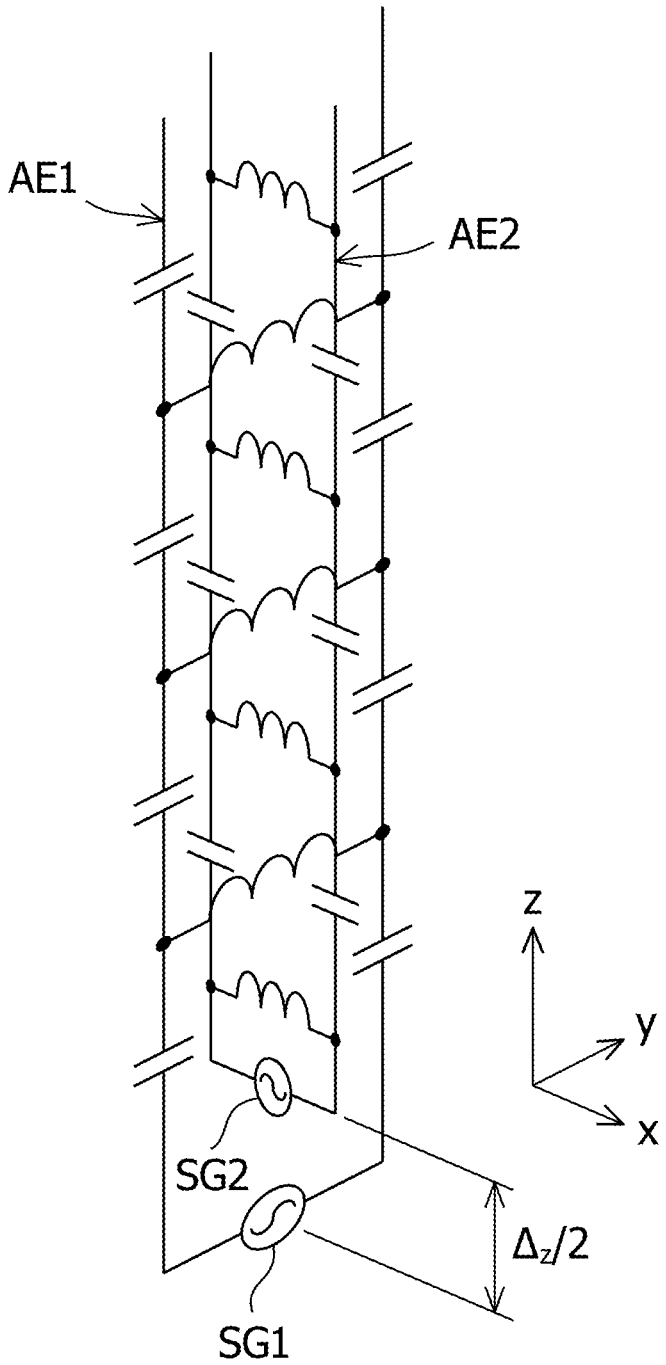
FIG. 13 is a perspective view schematically showing another embodiment of the leaky-wave antenna according to the present invention.

FIG. 13 shows another embodiment of the leaky-wave antenna according to the present invention. In FIG. 13, element units AE1, AE2 correspond to the element unit AE of FIG. 2, and signal generators SG1, SG2 connected to the element units AE1, AE2 correspond to the signal generator SG of FIG. 2. More specifically, the leaky-wave antenna of this embodiment combines two leaky-wave antennas of FIG. 2.

The element units AE1, AE2 are orthogonal to each other with their longitudinal axial lines being aligned, and also are displaced by Δz/2 in the z direction. The displacement Δz/2 is half the length Δz of the respective unit cells UC arrayed periodically as illustrated in FIG. 2.

The thus-combined two antennas have almost no correlation. Therefore, the leaky-wave antenna of this embodiment can be used as a two-branch MIMO antenna. Moreover, the leaky-wave antenna assures the same antenna diameter as the element units AE1, AE2 despite the presence of the two element units AE1, AE2. Accordingly, the two-branch MOMO antenna can be formed very thin.

The correlation between the two antennas can be sufficiently suppressed only by arranging the element units AE1, AE2 orthogonal to each other. In this regard, if the element units AE1, AE2 are displaced by Δz/2 in the z direction as above, the unit cell components of the element unit AE1 and those of the element unit AE2 can be vertically symmetric, contributing to further reduction in antenna correlation.

The element units AE1, AE2 in the antenna of this embodiment can substitute for the element unit AE of FIG. 8 or 9. Also, according to the antenna of this embodiment, a phase difference between unit cells in the element units AE1, AE2 may be set so that the combined antennas show the directivity, in a vertical plane, of an end-fire pattern (see FIG. 12).

The leaky-wave antennas of the respective embodiments may include, as a constituent element, a reflector such as a metal plate or a wall. In this case, the reflector is placed behind the element unit AE while spaced by about ¼-wavelength, for example. The leaky-wave antenna equipped with the reflector can narrow the beam width in a horizontal plane using the reflector and thus can be used as a sector antenna as well.

The characteristics in the left-handed band have been explained above, but the leaky-wave antenna of the present invention is also applicable to the right-handed band. In this case, the antenna shows a directivity in a vertical plane that tilts upward, and also ensures emission in the z direction.

The present invention is not limited to the techniques discussed in the above embodiments and instead, can be embodied in another mode that could provide similar functions. Furthermore, various modifications and additions can be made without departing from the gist of the claims.

INDUSTRIAL APPLICABILITY

The leaky-wave antenna according to the present invention is applicable as a base station antenna for mobile communications, i.e., substitutable for typical conventional dual-polarized base station antennas such as a sector antenna, an omnidirectional antenna, and a Yagi antenna. Because of being thin, the antenna can reduce wind load and has improved appearance.

REFERENCE SIGNS LIST

AE, AE1, AE2 element unit
SG, SG1, SG2 signal generator
C1, C2, C1', C2' capacitor
L1, L1' inductor
UC unit cell

The invention claimed is:

1. A leaky-wave antenna comprising as an element unit, a CRLH transmission line configured by multiply connecting CRLH unit cells in a periodic fashion between one ends and the opposite ends of two parallel lines, wherein the unit cells each has a left-handed series capacitor on each of the two parallel lines and has a left-handed parallel inductor between the two parallel lines, and when power is fed to the two parallel lines, the two parallel lines and the series capacitor serve to emit a vertical polarization component and also, the parallel inductor and a conductor between the two parallel lines serve to emit a horizontal polarization component.

2. The leaky-wave antenna according to claim 1, wherein the element unit is configured so that the vertical polarization component and the horizontal polarization component are emitted in equal amounts.

3. The leaky-wave antenna according to claim 1, wherein the element unit is configured to show a directivity, in a vertical plane, of an end-fire pattern.

4. A leaky-wave antenna comprising leaky-wave antennas according to claim 1 as first and second antennas, wherein the first and second antennas have element units that are combined orthogonal to each other with their longitudinal axial lines being aligned.

5. The leaky-wave antenna according to claim 4, wherein the element units of the first and second antennas are displaced from each other along the longitudinal axial line by half a length of the respective unit cells arrayed periodically.

6. The leaky-wave antenna according to claim 4, wherein the element units of the first and second antennas are configured so that their directivity in a vertical plane is of an end-fire pattern.

7. The leaky-wave antenna according to claim 4, further comprising a reflector for narrowing a beam width in a horizontal plane.

8. The leaky-wave antenna according to claim 4, wherein an interdigital capacitor or a parallel plate capacitor is used as the series capacitor.

9. The leaky-wave antenna according to claim 4, wherein a straight thin line or a meandering line is used as the parallel inductor.

10. The leaky-wave antenna according to claim 4, wherein a chipped element is used as the series capacitor and the parallel inductor.

11. The leaky-wave antenna according to claim 1, further comprising a reflector for narrowing a beam width in a horizontal plane.

12. The leaky-wave antenna according to claim 1, wherein an interdigital capacitor or a parallel plate capacitor is used as the series capacitor.

13. The leaky-wave antenna according to claim 1, wherein a straight thin line or a meandering line is used as the parallel inductor.

14. The leaky-wave antenna according to claim 1, wherein a chipped element is used as the series capacitor and the parallel inductor.

* * * * *